United States Patent [19]

Wertelewski et al.

[11] 3,949,563

[45] Apr. 13, 1976

[54] MINE ROOF SHIELD

[75] Inventors: Wilhelm Wertelewski; Jorg Schade, both of Datteln, Germany

[73] Assignee: Becorit Grubenausbau GmbH, Germany

[22] Filed: Feb. 28, 1975

[21] Appl. No.: 554,026

[30] Foreign Application Priority Data

Apr. 4, 1974 Germany ..... 2416306

[52] U.S. Cl. ..... 61/45 D

[51] Int. Cl.[2] ..... E21D 15/44

[58] Field of Search ..... 61/45 D; 299/31, 33

[56] References Cited

UNITED STATES PATENTS

| | | | |
|---|---|---|---|
| 3,728,863 | 4/1973 | Hidasi | 61/45 D |
| 3,830,070 | 8/1974 | Rosenberg | 61/45 D |
| 3,872,678 | 3/1975 | Shuttleworth | 61/45 D |

*Primary Examiner*—Jacob Shapiro

*Attorney, Agent, or Firm*—Berman, Aisenberg & Platt

[57] ABSTRACT

A shield support for underground mining operations having a roof bar pivotally mounted on the upper end of a caving shield and laterally extensible aperture sealing plates of L-section arranged along opposite sides of the roof bar and opposite sides of the caving shield, the plates on the roof bar extending back to the rearward edge of the roof bar and the plates on the caving shield extending no further forward than the arc described by the rearward end of the roof bar plates upon pivoting of the roof bar relative to the caving shield.

5 Claims, 4 Drawing Figures

-FIG.1-

Figure 1:
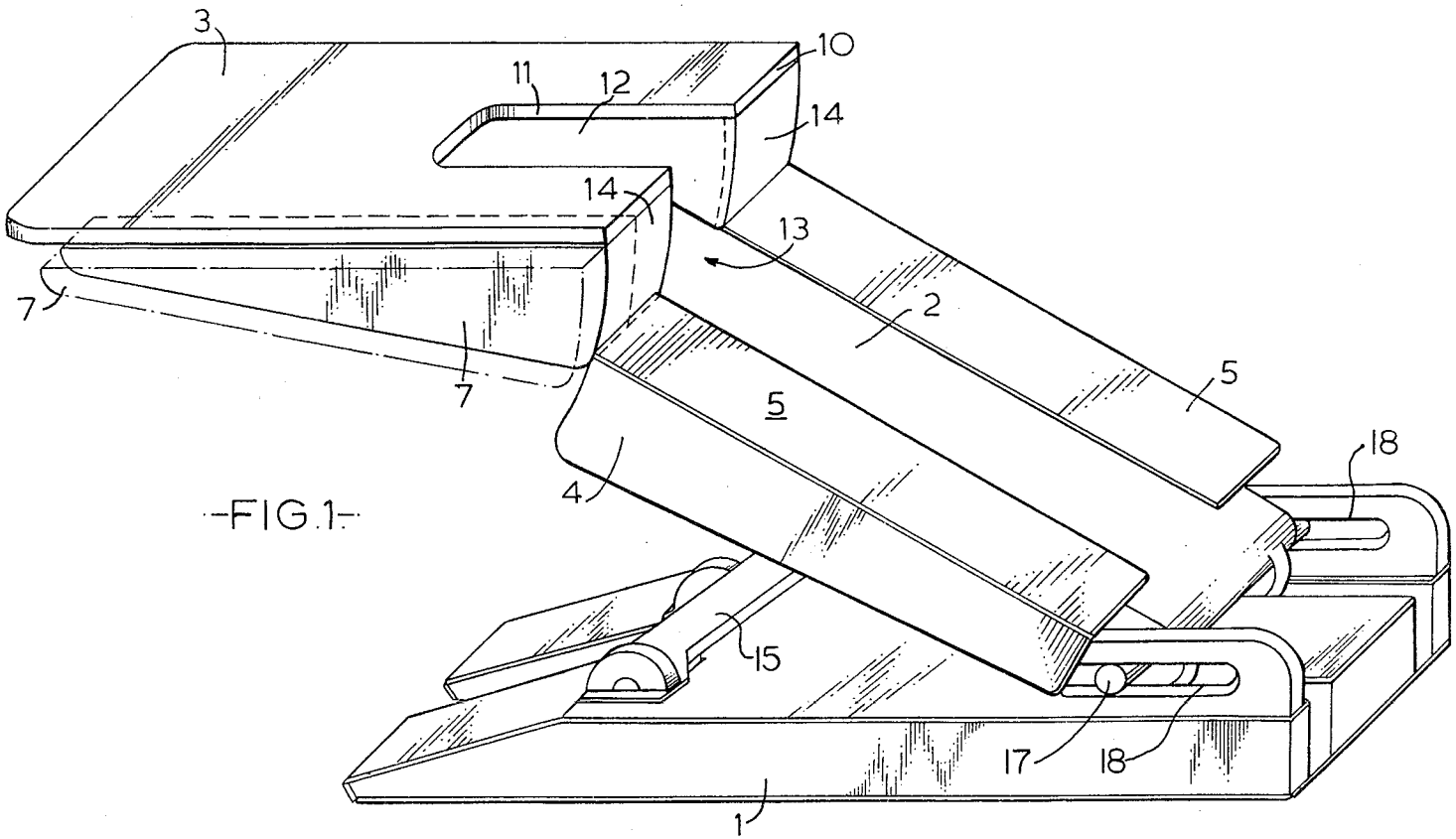

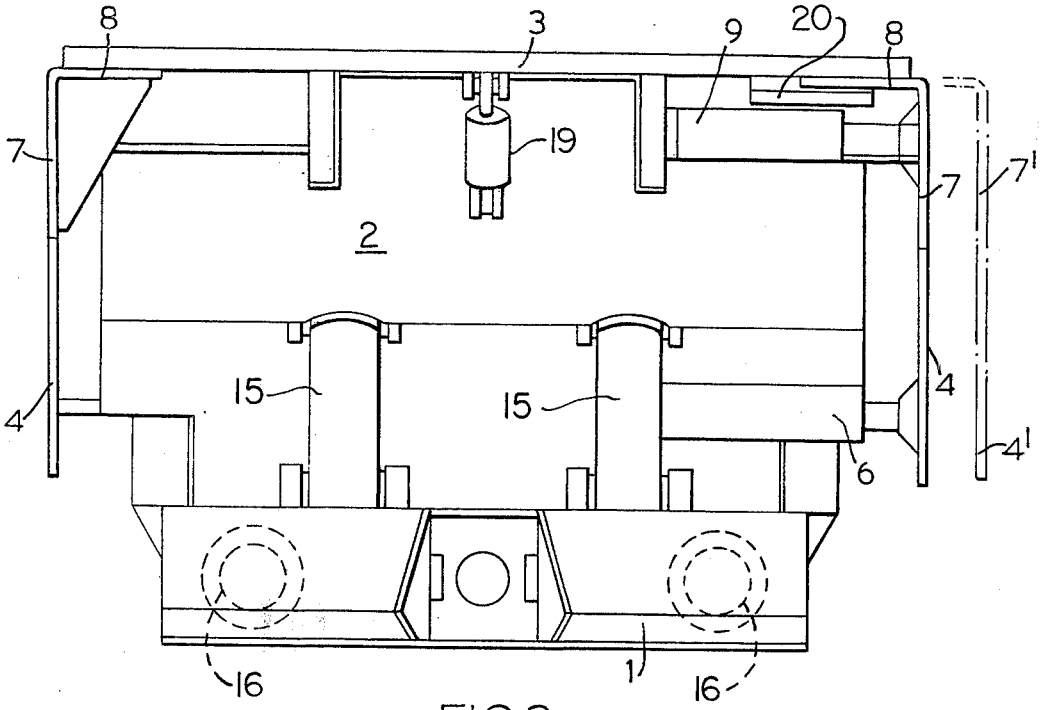
-FIG.3-

MINE ROOF SHIELD

The invention concerns a caving and stowing shield structure for a shield support in underground mine operations. Such shields have the task of shutting off the excavation held open by the support, from the roof and the stowing or caving so tightly that no rock pieces and as little dust as possible can penetrate into the excavator.

For the purpose it is known to fit L-shaped aperture sealing plates extensible laterally, in face longitudinal direction, on the sides of the caving shield and the roof bar of a shield support element. Between the shields and the L-shaped aperture sealing plates, springs are arranged, by means of which the side pieces — running normal to the stratification — of the aperture sealing plates of adjacent support elements are pressed against each other so that a seal results. This seal however is imperfect in the region between caving shield and roof bar. Although the aperture sealing plate of the caving shield is already extended so far into the region of the roof plate that a still further extension in this direction would lead to an intolerable impairment of the pivotability of the roof plate against the caving shield, a non-shielded aperture of considerable width remains in the said area with the known support.

The invention has the task of improving the caving and stowing shield of a shield support.

According to the invention there is provided a shield support for underground mining operations having a roof bar pivotally mounted at the upper end of a caving shield, wherein the roof bar and the shield are each equipped with L-shaped laterally extensible aperture-sealing plates, the plates of the roof bar extending to the rearward or goaf-side edge of the roof bar and the plates of the shield extending no further forward than the arc described by the roof bar plates upon pivoting of the roof bar relative to the shield.

With this construction the space between the parts — running normal to the stratification — of the L-shaped aperture sealing plates of the roof bar on the one hand and of the caving shield on the other hand are kept extremely small without the pivotability of the roof bar against the caving shield being hindered in any way by the aperture sealing plates.

A particularly narrow aperture results when the adjacent edges of the aperture sealing plates of the roof shield and the caving shield follow the arc which is described by the goaf-side edge of the roof bar when swivelling. In a preferred embodiment the aperture sealing plates are guided in each other in the region of the arc in such a way that they are mutually displaceable in a vertical plane but are not mutually displaceable in face longitudinal direction. By means of this guide on the one hand there results an excellent aperture seal and on the other hand the number of hydraulic cylinders can be kept down, which, running in face longitudinal direction, are arranged in a known way between the aperture sealing plates and the roof plate or the caving shield and are used for the displacement of the aperture sealing plates towards the roof plate or the caving shield. These hydraulic cylinders can also, as known, be used for mutually aligning adjacent support elements, wherein the side pieces — normal to the stratification — of the aperture sealing plates of adjacent support elements are supported against each other.

For the accomplishment of the seal in the roof area, aperture sealing guard plates running normal to the stratification are arranged on the inner sides of the side pieces — pointing towards the stowing — of the U-shaped roof bar and aperture sealing shields are arranged on the side piece edges — running in face longitudinal direction — of the U-shaped roof bar, and which, running essentially normal to the stratification, are bent in accordance with the swivel radius of the goaf-side edge of the roof bar.

By means of these seals the vertical caving of rock and dust in the region between caving shield and roof bar is completely avoided, and it is also avoided that debris lying on the caving shield can get into the swivel area of the roof bar and can impair its free pivotability.

Roof bars U-shaped in plan view with the side pieces pointing to the stowing are known. They enable the construction of shield support elements with smaller height than would be possible with the application of holohedral roof bars.

Below an embodiment of the caving and stowing shield according to the invention is described with the aid of the drawing.

Figures 2, 2A:
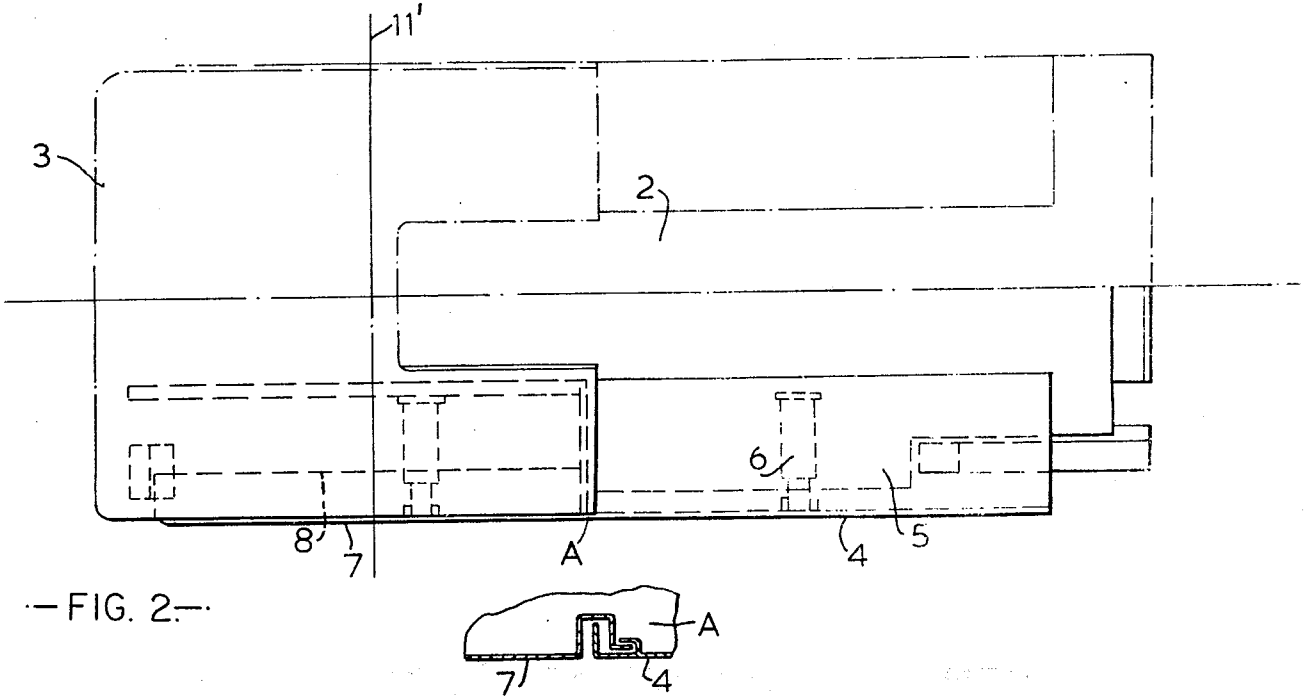

FIG. 1 shows a shield support element with caving and stowing shield in perspective view, FIG. 2 shows a diagrammatic plan view of this, FIG. 2A is a fragmentary, horizontal sectional view taken in the region A of FIG. 2, and FIG. 3 shows a front view of the shield support element shown in FIG. 1.

In the drawings the base plate of the shield support element is marked 1, the caving shield 2 and the roof bar 3.

The base plate 1 constitutes a ground-engaging structure from which the inclined caving shield 2 is pivotally supported at its lower end by hinge pin 17 displaceable in slots 18 by means of hydraulic rams 16. The shield 2 is also coupled to base 1 by legs 15 pivotally attached at their lower ends to the base 1 and at their upper ends to the shield 2. Thus the angle of inclination of shield 2 can be varied by operating rams 16.

The roof bar 3 is pivotally attached to the upper end of shield 2 by hinge means not shown but the axis of which is indicated by the line 11' in FIG. 2. A further hydraulic ram 19 pivotally attached at opposite ends respectively to the shield 2 and the roof bar 3 provides for pivoting roof bar 3 with respect to shield 2 about axis 11'.

The precise details of the roof support 1, 2, 3 are irrelevant to the invention which is concerned with the provision of the L-shaped aperture sealing plates to be described in a support of generally known construction. On both sides of the caving shield, L-shaped aperture sealing plates are arranged, the side pieces or limbs normal to the stratification of which are marked 4 and their side pieces running parallel to the back of the caving shield are marked 5. At least one of the L-shaped aperture sealing pltes 4, 5 is displaceable by the hydraulic cylinder 6 in face longitudinal direction towards the caving shield 2. The extended position of the side piece 4 perpendicular to stratification is marked 4' in FIG. 3.

In a similar way on both sides of the roof bar 3, L-shaped aperture sealing plates are arranged, the side pieces or limbs — normal to the stratification — of which, are marked 7 and their side pieces or limbs running parallel to and overlying a portion 20 of the roof bar are marked 8. A hydraulic cylinder 9 is used for the displacement of at least one of the aperture sealing plates 7, 8 in face longitudinal direction and the extended position is shown in dotted lines in FIG. 1 and 3 and is marked 7'.

As can be seen particularly in FIG. 1, the adjacent edges of the side pieces 7 and 4 — normal to the stratification — of the aperture sealing plates are constructed so that they follow the arc which is described by the goaf-side edge 10 of the roof bar 3, when the latter is pivoted towards the caving shield 2 about the connecting bolt not shown in FIG. 2 but indicated by the line 11'. In this area, which is marked A in FIG. 2, the side pieces 7 and 4, as can be seen in the sectional drawing in FIG. 2A, are guided into each other in such a way that they, whilst pivoting the roof plate 3 towards the caving shield 2, are displaceable towards each other in a vertical plane, whilst they cannot be mutually displaced in face longitudinal direction.

As can be seen in FIG. 1 aperture sealing plates 12 running normal to the stratification, are fastened on the inner sides 11 of the side pieces — pointing to the stowing — of the U-shaped roof bar 3, which plates interact with that part 13 of the caving shield 2 which extends as far as the articulation point at 11' of the roof bar.

Aperture sealing shields 14 are arranged on the goaf-side edges 10 of the U-shaped side pieces of the roof bar 3. The aperture sealing shields 14 run essentially normal to the stratification, they are however somewhat bent in a cylinder sleeve shape, wherein the radius of the cylinder corresponds to the swivel radius of the roof bar. The aperture sealing shields 14 act with the main part of the roof bar 2 or the side pieces — running parallel to the back of the roof bar 2 — of the L-shaped aperture sealing plates.

As can be seen in the embodiment, a complete packing towards the roof or the caving or stowing as well as of the individual support elements towards each other is attained. It is completely excluded that debris on the caving shield could hinder the pivoting of the roof bar towards the caving shield. Insofar as a packing completely impermeable to dust cannot be attained in the area between the roof bar and caving shield, then the dust falls into the part of the face excavation relatively far away from the working face, in which the ventilation speed is considerably less than in the vicinity of the working face, with the consequence that a large part of the dust sinks to the floor without being taken along with the ventilating current.

The size of the side piece 7 or 4 — perpendicular to stratification — of the L-shaped aperture sealing plates is such that the packing of two adjacent shield support elements is maintained even when one of the elements is advanced by the normal length of advance with regard to the other element and one of the elements is withdrawn so far, with regard to the other element, as normally occurs in operation. The dimensioning of the aperture sealing plates 12 and the aperture sealing shields 14 ensues in such a way that the packing is maintained during the normal operational pivoting of the roof bar.

We claim:

1. A shield support structure for underground mining operations comprising a ground-engaging structure;

an inclined caving shield pivotally supported at its lower rearward end from said ground-engaging structure;

a roof bar pivotally attached to the upper forward end of said caving shield and projecting forwardly thereof;

first laterally extensible L-section aperture-sealing plates each having one limb of the L-shape extending along one side of said roof bar to the rearward edge thereof and the other limb extending over a portion of said roof bar; and second laterally extensible L-section aperture-sealing plates each having one limb of the L-shape extending along one side of said caving shield and the other limb extending over said caving shield;

said second plates extending no further forward than the arc described by the rearward edges of said first plates upon pivoting of said roof bar relative to said caving shield.

2. A shield support structure according to claim 1 wherein the rearward edges of said first plates and the forward edges of said second plates are curved to follow said arc.

3. A shield support structure according to claim 2 wherein said first and second plates at said rearward and forward edges have interengaging formations whereby said edges are guided one within the other during relative displacement in a vertical direction, said formations preventing relative displacement of the plates in the longitudinal direction thereof.

4. A shield support structure according to claim 1 and further including hydraulic ram means arranged to act between the roof bar and said first plates to effect lateral extension of said first plates, and between said shield and said second plates to effect lateral extension of said second plates.

5. A shield support structure according to claim 1 wherein said roof bar is of U-shape and including third aperture-sealing plates extending downwardly from the general plane of the roof bar along the inner sides and free ends of the limbs of the U-shape, the third plates on the free ends of the limbs of the U-shape being curved to follow the arc described by such ends upon pivoting of the roof bar relative to the shield.

* * * * *